United States Patent [19]

Holman

[11] 4,161,311

[45] Jul. 17, 1979

[54] KERF CLAMP

[75] Inventor: Daniel V. Holman, Chicago, Ill.

[73] Assignee: Adjustable Clamp Company, Chicago, Ill.

[21] Appl. No.: 911,462

[22] Filed: Jun. 1, 1978

[51] Int. Cl.[2] ..... B25B 5/14

[52] U.S. Cl. ..... 269/49; 269/243; 269/285

[58] Field of Search ..... 269/37, 43, 47, 49, 269/243, 289 R, 285; 29/271

[56] References Cited

U.S. PATENT DOCUMENTS

| | | | |
|---|---|---|---|
| 2,803,278 | 8/1957 | Dean | 269/243 |
| 3,159,393 | 12/1964 | Villana | 269/49 |
| 4,076,228 | 2/1978 | Sheldon | 269/49 |

FOREIGN PATENT DOCUMENTS

| | | | |
|---|---|---|---|
| 51675 | 6/1910 | Switzerland | 269/49 |
| 551276 | 2/1943 | United Kingdom | 269/49 |

*Primary Examiner*—Robert C. Watson
*Attorney, Agent, or Firm*—Lockwood, Dewey, Alex & Cummings

[57] ABSTRACT

An improved kerf clamp for maintaining two sheet members in pre-disposed relation on either side of a kerf. The clamp is fabricated from sheet metal stock in such a way as to maximize strength and minimize material and production costs. The clamp includes a generally planar sheet metal base which is ribbed for added rigidity and includes an integral kerf blade which extends perpendicularly therefrom and has a stud screw extending axially from the distal end thereof. In use, the base is positioned underneath the sheet material to be clamped with the blade extending upwardly through a kerf cut therein. The clamp also includes a pressure part formed from sheet metal which is bent and shaped into a hollow tubular structure having a narrow upper gripping portion. A pair of sheet metal bulkhead-like inserts are mounted within the pressure part to impart rigidity and strength in compression. Aligned apertures through the top and bottom of the pressure part are adapted to receive the stud screw and kerf blade, respectively, when the pressure part is positioned on the upper surface of the sheet material. A wing nut on the upwardly protruding end of the base stud screw on tightening draws the base and pressure parts together thereby clamping the sheet material therebetween.

7 Claims, 5 Drawing Figures

FIG. 1
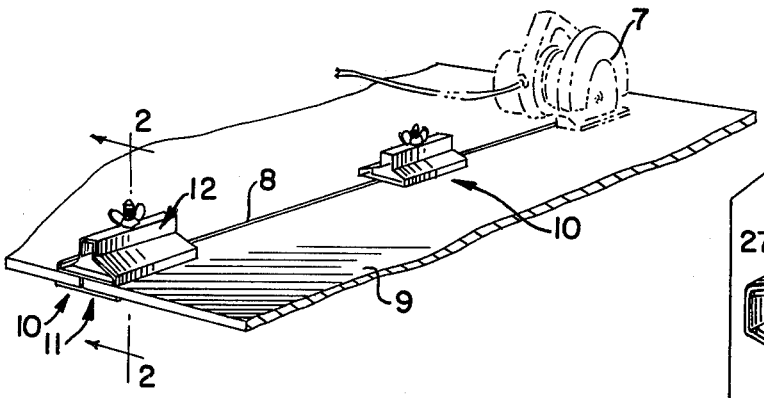
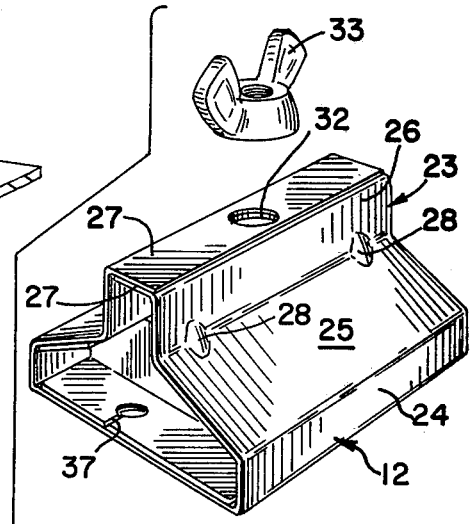
FIG. 2
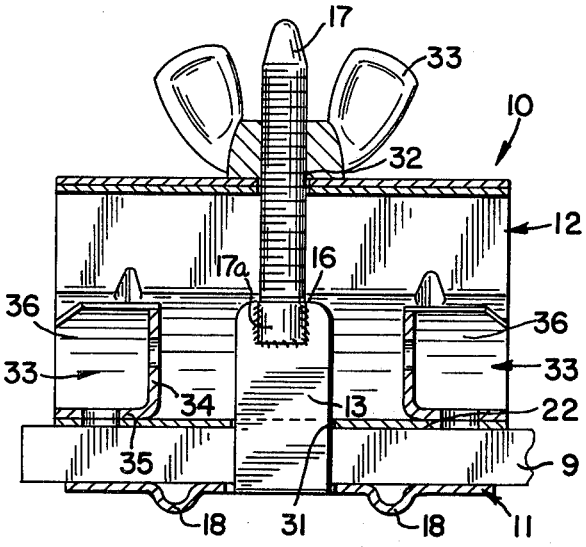
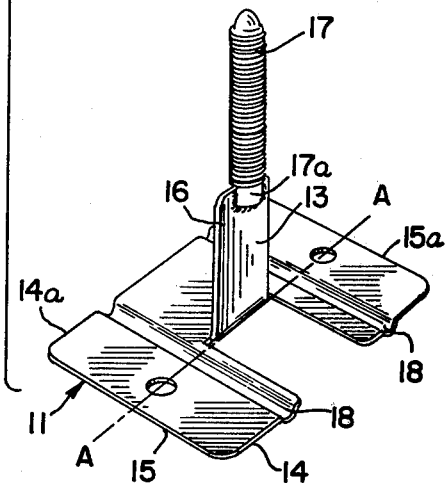
FIG. 4
FIG. 3
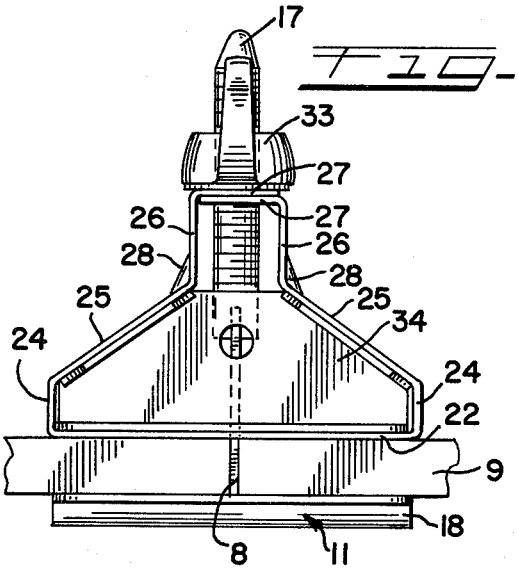
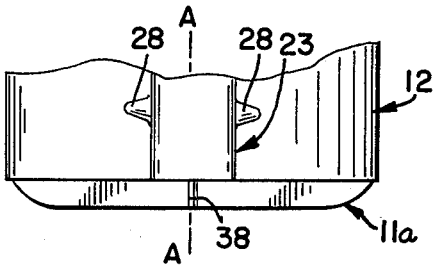
FIG. 5

KERF CLAMP

This invention relates to adjustable clamps which are adapted to be inserted in and moved along a kerf or cut in a sheet of material as it is being sawed or otherwise separated in a conventional manner. Such adjustable clamps are useful in supporting and holding in proper mating relationship severed pieces or sections of the sheet material so as to avoid binding, sagging, flexing, separating, bending, etc., while sawing or otherwise cutting same.

Heretofore known adjustable clamps for maintaining proper alignment between adjacent pieces of sheet material on either side of a cut or kerf have included solid metal or wooden blocks held together by a connecting blade having an adjustable fastening means thereon. Another adjustable clamp suitable for the same purpose has been formed of a hollow channel member of rectangular cross-section, positioned on one surface of the sheet material with a flat sheet member or base positioned on the other side thereof. A connecting blade extends upwardly and outwardly of the base through the kerf, through the channel member, and is fastened to the exterior side thereof. Such clamp members are shown and described in U.S. Pat. No. 4,076,228, issued Feb. 28, 1978 to the assignee of the present application.

The shortcomings and inefficiencies present in the heretofore known clamping members have been overcome by a novel clamp which may economically be made using sheet metal which is bent and joined in a particular manner to provide for structure rigidity while being light in weight. The clamp of the present invention comprises two members, a hollow tubular structure or pressure member having a narrow upper gripping portion, and a ribbed retaining sheet or base member which is adjustably securable to the pressure member. When used in connection with a sawing operation, both members of the clamp engage the piece of material being sawed or cut on opposing sides of a kerf therein. The ribbed base member is adapted to engage one surface of a sheet or piece of material on both sides of a kerf therein and includes a blade which projects at right angles to the bearing surface. The pressure structure also includes a planar bearing surface for engaging the opposite surface of the material on both sides of the kerf. The pressure structure is strengthened for withstanding high compression and moment loads by having bulkhead-like members mounted across its hollow interior.

The object of the invention, generally stated, is to provide an improved kerf clamp for maintaining a predisposed alignment between the juxtaposed mating edges of two portions of a piece of material as it is being cut or otherwise severed and characterized by being formed essentially from sheet metal stock in such a way as to maximize strength and minimize material and production costs.

More specific objects of the present invention will be apparent to those skilled in the art from the following detailed description of the invention, taken in conjunction with the accompanying drawings, wherein:

FIG. 1 is a perspective view of the clamp of the present invention mounted in place in a kerf which is being cut through a sheet of material;

FIG. 2 is a vertical sectional view on enlarged scale taken through one of the clamps on Line 2—2 of FIG. 1;

FIG. 3 is an end elevational view taken on Line 3—3 of FIG. 2; and FIG. 4 is an exploded perspective view of the clamp shown in FIG. 1.

FIG. 5 is an elevational view of a modification of the base plate.

Referring to FIG. 1, each clamp 10 comprises a ribbed base member 11 and a pressure structure or member 12. In the preferred embodiment, both members 11 and 12 are formed of sheet metal bent and joined to provide rigidity, in a substantially flat structure in the base, and in a hollow tubular structure having a narrow upper gripping portion in the pressure member.

As shown most clearly in FIGS. 2 and 4, the base 11 is essentially formed from a single piece of metal sheet material, preferably steel or aluminum alloy, which is generally rectangular in shape. In the preferred embodiment, an elongate blade 13 extends outwardly of the plane of base 11 generally perpendicularly thereto from a position along the longitudinal axis A—A of the base. The base further includes pairs of opposing elongate sides 14–14*a* and opposing shorter sides 15–15*a*. The blade 13 is preferably formed from the base 11 by making a pair of substantially parallel cuts from one elongate side 14 thereof to the axis A—A. The material between those cuts is bent upright along the axis A—A and defines the blade 13. The width of the blade 13 is sufficient to maintain the clamp in proper orientation astride a cut or kerf in a sheet of material, but is not so wide as to prohibit movement of the clamp along a cut which is curved. A stud screw or bolt 17 preferably includes a bifurcated bottom end 17*a*, which is adapted to fit over the distal end 16 of blade 13, extend axially therefrom, and fasten thereto by welding. The base further includes a pair of strengthening ribs or deformations 18—18 which, in this embodiment, preferably extend across the width thereof at right angles to the blade 13. The ribs 13 extend downwardly out of the plane of contact between the base and any sheet of material positioned in the clamp.

Referring to FIGS. 2, 3 and 4, the clamp pressure member 12, in the preferred embodiment, is formed of an elongate piece of sheet metal which is bent into a generally tubular structure having a relatively wide flat bottom side 22 and a narrow upper gripping portion, generally indicated at 23. As shown most clearly in FIG. 3, the tubular structure further includes a shoulder wall 25 extending inwardly and upwardly from horizontal creases in the sheet metal defining the top edge of each of the short side walls 24—24. The narrow, generally rectangular gripping portion 23 extends from the upper boundary of each shoulder 25 defining short opposed vertical surfaces 26—26 and encloses the top of the pressure member with overlapping horizontal walls 27—27 which are preferably welded together. A plurality of strengthening ridges 28—28 extend across the elbow type boundary between the top of each shoulder wall 25 and the bottom of each of the opposing vertical surfaces 26—26 to provide additional rigidity between the gripping portion 23 and the remainder of the hollow tubular structure.

As shown most clearly in FIG. 2, the flat bottom side 22 of pressure structure 12 includes an elongate slot 31 therethrough having a first circular aperture (not shown) positioned substantially centrally therealong. The slot and aperture are of sufficient size to allow the passage of blade 13 and stud screw 17 therethrough. A second circular aperture 32 is aligned with first aperture 31 and positioned through the overlapping horizontal walls 27—27 at the top of the pressure structure which allows the stud screw 17 to extend therethrough in axially movable relation when the base is joined with the pressure member in clamping relation. A wing nut 33 of convention configuration may be threaded on the distal end of stud screw 17 and moved axially therealong until the nut is snugly fitted against the top of the pressure structure. It can be understood that other fastener means may be provided between the blade 13 and pressure structure 12 within the scope of the invention.

Referring to FIGS. 2 and 3, additional rigidity is provided to pressure structure 12 without substantially increasing the weight of or the amount of material therein by mounting a pair of lightweight sheet metal bulkhead-like members, generally indicated at 33—33, across the hollow interior of the pressure structure. Each bulkhead-like member 33 includes a truncated triangular web portion 34 which is adapted to extend vertically across the hollow opening adjacent the bottom of the pressure structure interior. A foot or bottom flange 35 extends horizontally from the bottom edge of the vertical web portion 34 so as to have bearing engagement with the inner surface of the bottom side 22. Each flange 35 may include a guide marker 37 centrally thereon. When the base 11 is mounted on the pressure member 12, the marker 37 is in the plane defined by blade 13. Each member 33 further includes a pair of opposed flanges or tabs 36—36 which also extend from the web 34 in like general direction to the foot flange 35 and are adapted to provide surface engagement with the inside surfaces of the respective shoulder walls 25—25. As with the foot flange, each of the opposed flanges 36 is welded to the shoulder wall 25 adjacent thereto.

In use, it will be seen that the upper surface of the ribbed base 11 and the lower surface of the pressure member bottom side 22 are substantially flat or planar surfaces which are adapted to engage the bottom and top surfaces, respectively, of the sheet 9, or other object being cut, from opposed sides of the kerf 8 therein. After the saw 7 or other cutting tool has entered the sheet 9 a sufficient distance to accommodate one of the clamps 10, it is inserted in the end of the kerf, with the aid of the marker 37, and its wing nut 33 is tightened. As the saw 7 continues to lengthen the kerf 8 in the sheet 9, it will be seen that the clamp 10 that was put in place in the starting end of the kerf 8 may be loosened and moved inwardly to a position adjacent where the saw is temporarily stopped. Then, a second clamp 10 may be put in place at the beginning of the kerf 8 to provide added alignment retaining means. This same procedure of advancing one or more clamps 10 and adding another clamp may be repeated as necessary, so that no binding or twisting of the saw blade occurs and the pieces do not droop, curl, bend, flex or separate, or fall apart when the end of the kerf is reached. Usually two or three clamps will suffice for most sawing operations. When the kerf 8 has been completed in the sheet 9, the clamps 10 may be easily removed for further use.

Referring to FIG. 5, a modification of the base plate is shown at 11*a*. Base plate 11*a* is lengthened to extend beyond the open ends of the pressure member 12 as mounted thereon. A guide marker 38 is centrally positioned along the axis A—A in alignment with blade 13 (FIG. 4). The guide marker 38 may be aligned with a cut or kerf to facilitate feeding the blade 13 therein.

While one embodiment of the clamp 10 has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

I claim:

1. In a kerf clamp of the type including a clamp base having an upper horizontal work piece engaging surface, a rigid kerf blade projecting perpendicularly upwardly from said base horizontal surface, male fastener means mounted on the upper distal end of said blade, female fastener means adapted for mating engagement with said male fastener means, and a clamp pressure member having a lower horizontal work piece engaging surface and having a slot opening therein adapted for receiving said kerf blade and male fastener means therethrough and an additional opening through the top surface of said clamp pressure member which is aligned with said slot opening for receiving said male fastener means, said kerf blade and said vertical slot providing means to align said clamp base and pressure member with each other and with a kerf; the improvement wherein said clamp base includes a pair of elongate strengthening ribs or deformations extending substantially across said base in a direction transverse to the plane of said kerf blade for providing added structural rigidity to said base, and said pressure member is a generally tubular structure including a relatively large flat bottom wall defining said lower work piece engaging surface, and a narrow upper gripping portion, said structure having opposed sloping shoulder walls between said upper gripping portion and said flat base for providing added strength in compression to said pressure member.

2. The kerf clamp as defined in claim 1 wherein said pressure member further includes a bulkhead-like member positioned across the hollow interior thereof between said opposing shoulder walls and said bottom wall for providing additional strength in compression to said pressure member, said bulkhead-like member including a vertical web portion, a horizontal flange or foot extending horizontally from the bottom of said web in fastened surface engagement with an upper surface of said bottom wall, and a pair of opposing shoulder-like tabs extending from said web with each in fastened surface engagement with an inner surface of one of said sloping walls.

3. The kerf clamp as defined in claim 1 wherein said kerf blade is integral with said clamp blade and includes a right angle bend at the bottom thereof which is substantially parallel to the opposed side edges of said base and defines an elongate cut-out in said base extending from said blade right angle bend to one of said opposing side surfaces.

4. The kerf clamp as defined in claim 2 wherein said fastened surface engagement is a spot-welded engagement.

5. The kerf clamp as defined in claim 1 wherein each juncture between said shoulder walls and said upper gripping portion includes a compound curved deformation extending perpendicularly thereacross for adding rigidity to said structure.

6. In a kerf clamp for maintaining in aligned relation the opposing sides of a cut or kerf in a sheet of material, said clamp comprising: a clamp base made of sheet metal having an upper work piece engaging surface, a rigid kerf blade projecting perpendicularly upwardly from said base upper surface, a threaded stud member mounted on an upper distal end of said blade and extending co-axially therefrom, a wing nut adapted for mating engagement with said threaded stud member, and a pair of elongate strengthening ribs extending substantially across said base in a direction transverse to the plane of said kerf blade; and a clamp pressure member made of sheet metal defining a generally tubular structure including a large flat bottom wall with a lower work piece engaging surface, and a narrow upper gripping portion, said lower work piece engaging surface having a slot opening therein adapted for receiving said kerf blade and stud member therethrough, said pressure member further including a pair of side walls with each extending perpendicularly upward from respective ones of the opposing sides of said bottom wall, a pair of sloping shoulder walls with each extending upwardly and inwardly from the top of respective ones of said side walls, said narrow gripping portion including opposed vertical walls with each extending from the top of respective ones of said sloping shoulder walls, and opposed horizontal walls extending respectively from the top of each of respective ones of said gripping portion vertical walls, said horizontal walls meeting in overlapping relation to define the top of said pressure member, aligned apertures being positioned through said overlapping horizontal walls which are adapted for the passage of said threaded stud member therethrough, and a bulkhead-like member extending across the hollow interior of said pressure member between said opposing shoulder walls and said bottom wall for providing additional strength in compression to said pressure member.

7. The kerf clamp as defined in claims 1 or 6 wherein one of said ribbed base and said pressure member include means thereon for guiding said kerf blade into a kerf.

* * * * *